United States Patent [19]

Sato et al.

[11] Patent Number: 4,638,845

[45] Date of Patent: Jan. 27, 1987

[54] PROCESS FOR MAKING FOUNDRY MOLDS

[75] Inventors: Kanichi Sato; Mikio Setoyama; Shoji Kiguchi, all of Hirakata; Toshio Tanaka, Daito, all of Japan

[73] Assignee: Kabushiki Kaisha Komatsu Seisakusho, Tokyo, Japan

[21] Appl. No.: 774,412

[22] Filed: Sep. 10, 1985

[30] Foreign Application Priority Data

Sep. 13, 1984 [JP] Japan ..... 59-190623

[51] Int. Cl.[4] ..... B22C 9/02; B22C 9/12

[52] U.S. Cl. ..... 164/12; 164/15; 164/16; 164/33

[58] Field of Search ..... 164/6, 12, 15, 16, 33

[56] References Cited

U.S. PATENT DOCUMENTS

| | | | |
|---|---|---|---|
| 3,692,085 | 9/1972 | Brown et al. | 164/15 |
| 4,043,380 | 8/1977 | Valentine | 164/6 X |
| 4,196,768 | 4/1980 | Nakata | 164/15 |
| 4,518,031 | 5/1985 | Yamanishi et al. | 164/526 |
| 4,535,831 | 8/1985 | Sato et al. | 164/33 |

FOREIGN PATENT DOCUMENTS

| | | | |
|---|---|---|---|
| 50-38054 | 12/1975 | Japan | 164/15 |
| 54-1231 | 1/1979 | Japan | 164/15 |
| 55-30341 | 3/1980 | Japan | 164/6 |
| 58-107250 | 6/1983 | Japan | 164/15 |
| 58-187230 | 11/1983 | Japan | 164/15 |
| 58-187232 | 11/1983 | Japan . | |
| 58-202946 | 11/1983 | Japan | 164/15 |

*Primary Examiner*—Nicholas P. Godici
*Assistant Examiner*—J. Reed Batten, Jr.
*Attorney, Agent, or Firm*—Armstrong, Nikaido, Marmelstein & Kubovcik

[57] ABSTRACT

A process for making a foundry mold for use in metal casting, which comprises the steps of heating and drying mold sand composed of refractory particles and a water-soluble binding agent, charging a cavity formed in a mold pattern with the mold sand under dried condition, during the charging step, moisture being kept on the peripheral surface of the mold to be made, and heating the whole pattern of which the cavity has been filled completely with the mold sand to thereby cure mainly the peripheral surface of the mold.

12 Claims, 10 Drawing Figures

PROCESS FOR MAKING FOUNDRY MOLDS

BACKGROUND OF THE INVENTION

1. Field of the invention

This invention relates to a process for making foundry molds for use in metal casting through heating, drying and curing steps, and more particularly to an improved process for making foundry molds which comprises steps of filling a mold pattern with mold sand composed of refractory particles and a water-soluble binding agent added thereto, and then curing the mold sand by exposing it to microwave energy thereby making a foundry mold having a hardened layer on the outer peripheral surface thereof.

2. Description of the prior art

As for processes for making foundry molds for use in metal casting which includes a step of curing mold sand by exposing it to microwave energy, those disclosed, for example, in U.S. Pat. No. 4,518,031 (By Yamanashi et al) and Japanese Patent Application Laid-Open Publication No. 58-187232 etc. have been so far employed.

These publicly known processes each comprise steps of making a foundry mold with wet mold sand composed of refractory material particles to which a binding agent such as, for example, water glass etc. is added and then heating and drying the mold to be cured thus cured by exposing it to microwave energy thereby making a mold having a hardened layer on the outer peripheral surface thereof.

Such prior art processes for making molds have been disadvantageous in that since the mold pattern to form a mold is filled with wet mold sand, the fluidity of the mold sand in the mold pattern is poor, and so in case of making a mold having a complicated shape, it is difficult to fill the mold pattern completely with the mold sand.

Further, for the purpose of forming a hardened layer on the outer peripheral surface of the mold, a method of applying a water-soluble mold wash on the outer peripheral surface of the mold to be cured by means of a brush or by spraying after the fabrication of the mold is disclosed in the Japanese Patent Publication No. 55-29778 (Assignee of which is KABUSHIKI KAISHA KOMATSU SEISAKUSHO). This prior art method has, however, been disadvantageous in that the adhesion of the coating layer to the mold becomes insufficient; the mold tends to be damaged during casting process, and the used mold cannot be easily broken after casting process thus causing inconveniences when the mold is put to reuse.

SUMMARY OF THE INVENTION

The present invention has been devised to eliminate the above-mentioned disadvantages in the prior art processes, and has for its object to provide a process for making a foundry mold in which the fluidity of the mold sand in a mold pattern is high enough to ensure that, even in case of making a mold having a complicated shape, the pattern is filled completely with mold sand.

Another object of the present invention is to provide a process for making a mold in which since the mold is cured gradually from its outer peripheral surface thereof by the action of steam passing from the outer peripheral surface of the mold through the inside thereof to the outside thereof, the adhesiveness of a coating layer to the mold sand laid on the outer peripheral surface of the mold becomes excellent, and also since the strength of the mold surface is high, whilst the strength of the inside of the mold is low, the mold is not damaged during casting process, and the mold can be easily broken after completion of casting.

To achieve the aforementioned objects, according to the present invention, there is provided a process for making a mold which comprises the steps of heating and drying mold sand composed of refractory particles and a water-soluble binding agent; filling a cavity formed in a mold pattern arranged within a pattern flask with the mold sand under dried condition, during the filling step, moisture being kept on the outer peripheral surface of the mold to be cured, and then heating the whole pattern flask which has been filled completely with the mold sand to thereby cure mainly the outer peripheral surface of the mold.

Further, the present invention provides a process for making a mold, characterized in that the mold sand is a mixture of refractory particles and water-soluble binding agent.

Still further, according to the present invention, there is provided a process for making a mold, characterized in that the mold sand is comprised of refractory particles, the surface of which is coated with a water-soluble binding agent.

Still further, according to the present invention, there is provided a process for making a mold, characterized in that before the mold pattern is filled with mold sand, the inner peripheral surface of the cavity formed in the pattern is coated with a water-soluble mold wash to form a coating layer thereby keeping moisture on the outer peripheral surface of the mold to be cured.

Still further, according to the present invention, there is provided a process for making a mold, characterized in that before the mold pattern is filled with mold sand the inner peripheral surface of the cavity formed in the pattern is coated with water to form a water film layer thereby keeping moisture on the outer peripheral surface of the mold to be cured.

Still further, the present invention provides a process for making a mold, characterized in that the whole pattern flask is heated by exposing it to microwave energy.

The above and many other advantages, features and additional objects of the present invention will become apparent to those skilled in the art upon making reference to the following detailed description and accompanying drawings in which preferred embodiments incorporating the principles of the present invention are shown by way of illustrating example.

DETAILED DESCRIPTION OF THE INVENTION

Figure 1:
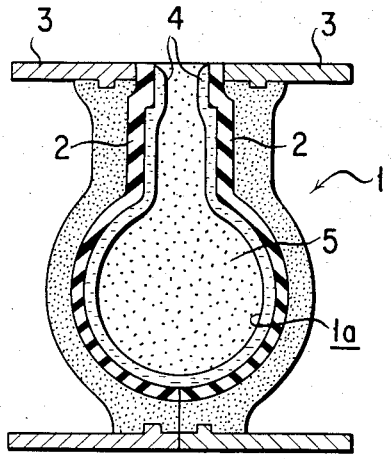
FIGS. 1 and 2 are schematic sectional views showing an embodiment of process for making a mold according to the present invention.
Figure 2:
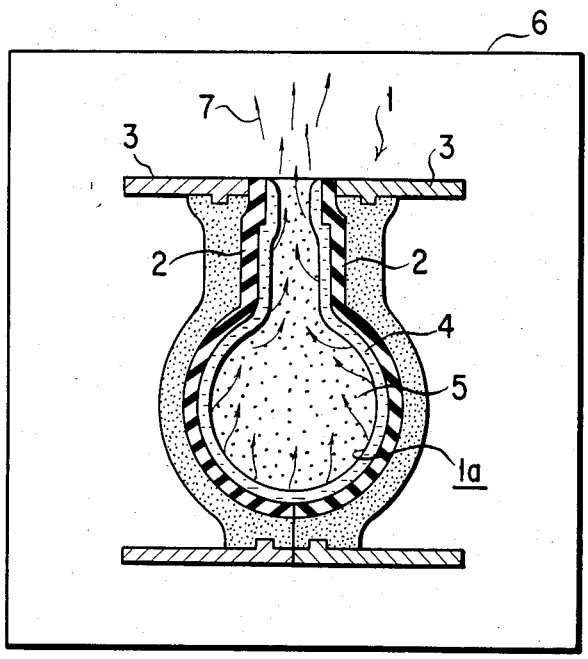

A first embodiment of the present invention will now be described below with reference to FIGS. 1 and 2. In FIGS. 1 and 2, reference numeral 1 denotes a female mold pattern split into two halves and having a layer 2 of heat resistant material such as heat-resistant silicone rubber applied to the inner peripheral surface thereof, and 3 a part of metal flask for holding the mold pattern 1.

The mold pattern 1 is coated with a water-soluble mold wash or water by pouring and turning over the pattern upside down or by spraying or by means of a brush to thereby form a coating layer 4 on the inner peripheral surface of cavity 1*a* formed in the mold pattern 1. After that, mold sand 5 composed of dried refractory particles and a water-soluble binding agent is charged into the mold pattern 1. Thereafter, the whole pattern flask containing therein the pattern 1 filled with mold sand 5 is placed in a microwave oven 6, and dried and cured. Since the mold sand 5 is kept dry, even if the cavity formed in the pattern 1 has a complicated shape, the mold sand can be filled up completely into such a cavity. Further, during heating by exposing to microwave energy, the moisture contained in the water-soluble coating layer 4 is heated to generate steam 7 which is then discharged from the outer peripheral surface of the mold to the outside through the inside thereof. At that time, the water-soluble binding agent containing in or coated on the dry mold sand is subjected, in turn, to dissolution, adhesion and drying by the action of steam and by heating to thereby enable the mold to be cured gradually from the outer peripheral surface thereof. As a result, such a hardness distribution is obtained in the mold that the hardness increases in the direction from the inside of the mold towards the outer peripheral surface thereof.

After drying process, the pattern 1 is split into two halves to take out the completed foundry mold.

Examples of the above-described water-soluble mold wash and mold sand are indicated below.

EXAMPLE 1

(1) Water-soluble mold wash:

Forming material: 100 parts by weight of zircon powder (#325 and under)

Water-soluble binding agent: 40 parts by weight of 1% aqueous solution of carboxymethylcellulose Water-glass: 1 part by weight (2) Mold sand:

Flattery silica sand: 100 parts by weight

Water-glass: 3 parts by weight

The mold sand, i.e. mixture of Flattery silica sand (collected at Flattery, Queensland, Australia) and water-glass was kneaded for 5 minutes and dried by blowing hot air kept at a temperature of 50° C.

A test mold pattern formed therein with a cylindrical cavity having a diameter 50 mm and a height of 50 mm was firstly coated with the above-described water-soluble mold wash by pouring it into the cavity and turning over the pattern upside down, and then the aforesaid dried mold sand was charged into the cavity and cured by exposing the whole pattern to microwave energy for one minute to make a test mold. The compressive strength of the mold was measured and found to be 47.3 $Kg/cm^2$.

COMPARATIVE EXAMPLE 1

The same mold sand was charged into the same cavity, but which was not coated thereon with any mold wash, and then exposed to microwave energy. In this case, the mold thus made was not cured and kept loose.

EXAMPLE 2

When the cavity in the pattern was coated or sprayed on the inner peripheral surface thereof with water instead of application of the water-soluble mold wash and filled with the above-mentioned mold sand, and then exposed to microwave energy, the mold sand was cured and completed. The compressive strength was measured and found to be 35.6 $Kg/cm^2$.

Next, a second embodiment of the present invention will be described in detail below with reference to FIGS. 3 and 4.

Refractory particles, i.e., 100 parts by weight of Flattery silica sand and 3 parts by weight of water-glass as a water-soluble binding agent are mixed sufficiently for 5 minutes, and then heated by hot air kept at a temperature of 80° to 100° C. for about 10 minutes to evaporate moisture so that completely dried mold sand was obtained. The mold sand thus obtained is kept under such a condition as the surfaces of the particles are coated with the water-soluble binding agent or the particles are mixed with the water-soluble binding agent.

Figure 3:
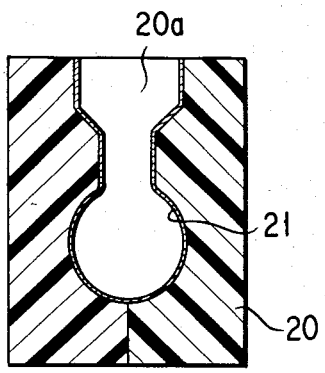
FIGS. 3, 4 and 5 are schematic sectional views showing another embodiment of process for making a mold according to the present invention.
Figure 4:
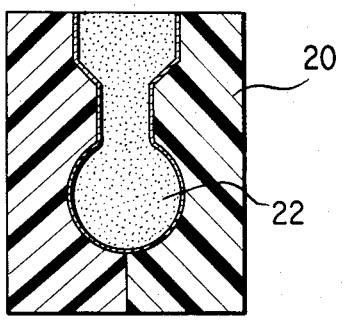

Next, after the inner peripheral surface of a cavity 20*a* formed in a mold pattern 20 shown in FIG. 3 is uniformly sprayed with water, and then filled with mold sand 22 as shown in FIG. 4. When filling the cavity 20*a* with mold sand 22, the latter is completely dried and has excellent fluidity, and therefore even a cavity having a complicated shape can be filled completely with the mold sand.

Figure 5:
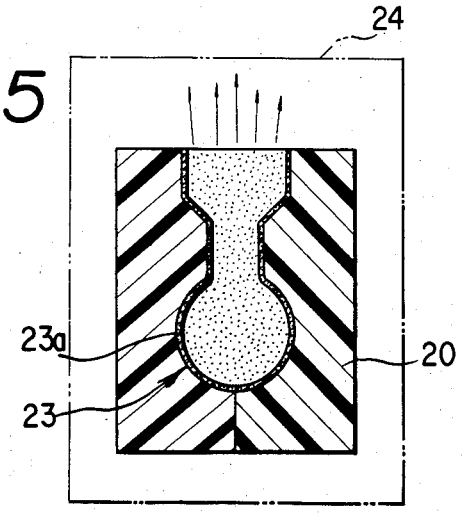

Subsequently, the pattern 20 is put into a heating/drying oven 24 as shown in FIG. 5, and then the whole pattern 20 whose cavity 20*a* is filled with mold sand 22 is dried by heating. As a result, the moisture contained in the water-soluble binding agent on the surface of the mold 23 to be cured which is dissolved again by water sprayed on the inner peripheral surface of the cavity 20*a* will evaporate completely resulting in mold sand 22 laid on the peripheral surface of the mold to be cured being cured and surfacehardened by the water-soluble binding agent thereby forming a hardened layer 23*a*.

After the heating process, the pattern 20 is taken out from the heating oven 24 and cooled, and then a completed mold 23 is taken out from the pattern 20. The mold 23 thus produced has the surface hardened layer 23*a* whose compressive strength is as high as 47.3 $Kg/cm^2$, and so there is no risk of the mold 23 being damaged during casting process. Further, since the inside of the mold 23 consists of a mixture of the refractory particles and the water-soluble binding agent kept under dried condition, and the mold 23 can be readily broken down. Therefore, in case of taking out a core from inside the cast article or taking out the cast article from the mold 23, the latter can be easily broken.

Figure 6:
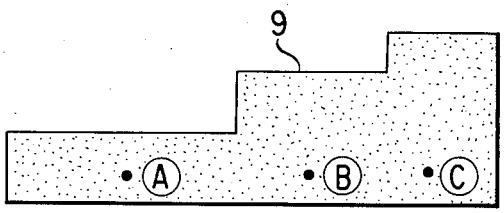
FIG. 6 is a side elevational views of a test piece taken out from the mold produced by the process for making a mold according to the present invention.

FIG. 6 illustrates a test piece 9 obtained by cutting part of the mold produced by the above-mentioned first embodiment of the process for making a mold, the surface of the test piece being of a stepped shape as shown and coated with the water-soluble binding agent.

Figure 7:
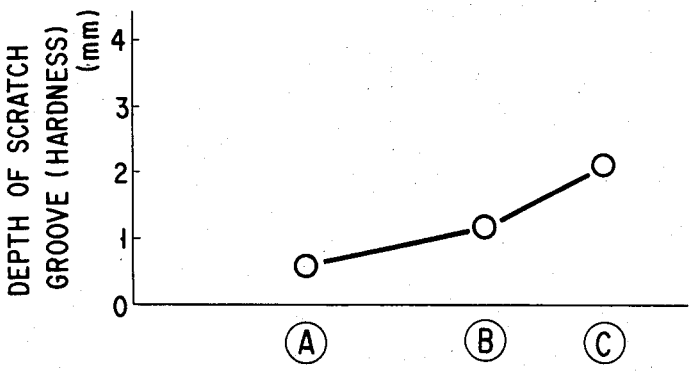
FIG. 7 is a graph showing the result of measurements of hardness made to the test piece shown in FIG. 6.

The side of the test piece 9 was formed with scratch grooves at positions A, B and C having different depths from the outer peripheral surface thereof. The depths of the scratch grooves varied depending on the distances from the outer peripheral surface as shown in FIG. 7.

As the distance from the outer peripheral surface was shorter, the depth of the groove was shallower. This means that as the groove is nearer the outer peripheral surface of the test piece an increase in the hardness is obtained.

Figure 8:
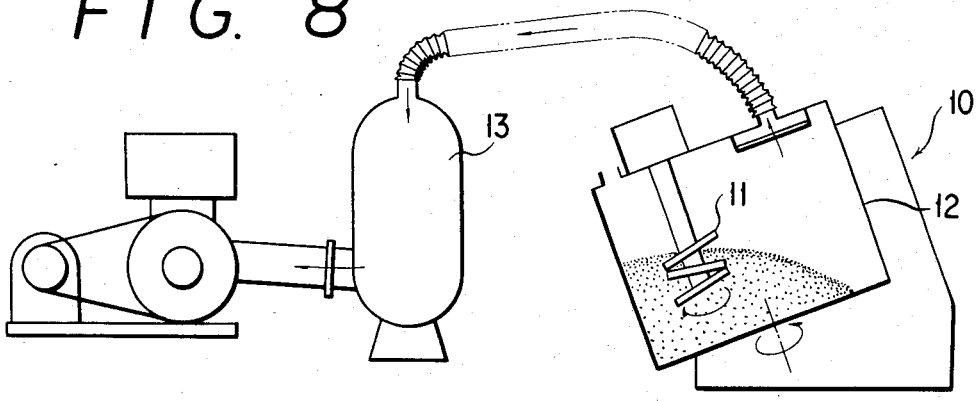
FIGS. 8 and 9 are schematic explanatory views showing two different systems for producing mold sands having curing properties by heating and used in the process for making a mold according to the present invention.
Figure 9:
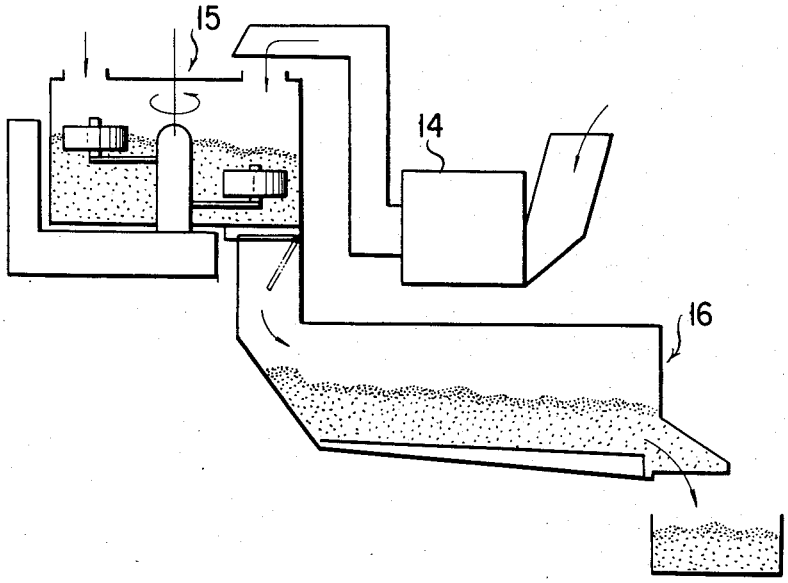

In the next place, two examples of process for producing mold sand composed of refractory particles coated with the above-mentioned water-soluble binding agent will be described below with reference to FIGS. 8 and 9.

(1) Vacuum drying process (Refer to FIG. 8):

Refractory particles and a water-soluble binding agent are charged into and stirred by a reversed current type high speed mixer 10. As a result, refractory particles are coated with the water-soluble binding agent by the action of an agitator 11 and a rotary drum 12 which are rotated in opposite direction, while the inside of the drum 12 is kept under vacuum by means of a vacuum trap 13 thereby evaporating the moisture on the mold sand to thereby dry the latter.

(2) Hot coating process (Refer to FIG. 9):

Refractory particles are previously heated by means of a sand heating apparatus 14 to a temperature range of 50° to 200° C. Subsequently, aqueous solution of the water-soluble binding agent produced by the action of a high speed mixer 15 (or reversed current type high speed mixer) is added to the heated refractory particles and mixed with the latter to thereby coat the particles with the aqueous solution and at the same time remove the moisture, and thereafter the sand is discharged. However, different from the vacuum drying process, the sand particles cannot be completely dried, and so cooling and drying of them are made by means of an air cooling and drying apparatus 16, while preventing blocking of the particles and change of them into composite particles.

Out of the above-mentioned two embodiments, the former brings forth such effects as (1) coating of the refractory particles can be made uniformly by means of the rotary drum 12 which is rotated in the direction opposite to that of the agitator 11 rotating at a high speed; (2) the particles are subjected to a vacuum while they are agitated so that blocking of the particles due to cohesion of water and drying under vacuum may be eliminated and change of them into composite particles can be prevented; and (3) the drying under vacuum enables the sand particles to be completely dried, and so the mold sand thus obtained has a high fluidity.

Whilst, the latter can provide such effects as (1) uniform coating of the sand particles can be made and a higher productivity can be obtained; and (2) since the fluidized bed type air cooler device is employed, blocking of the refractory particles and change of them into composite particles can be prevented.

According to the aforementioned two processes for producing mold sand, mold sands of the following compositions were applied with the same water-soluble mold wash and cured by exposing them at one minute to microwave energy having the output of 4 KW to thereby make test pieces of a mold. The compressive strength of the test pieces thus made were measured. For comparison purposes, the compressive strength of test molds made by using mold sands mixed with the same powdered water-soluble binding agent was measured.

EXAMPLE 3

Mixing ratio of mold sand:

Refractory particles: 100 parts by weight of Flattery silica sand

Water-soluble binding agent: 3 parts by weight of waterglass

Water: 1 part by weight

Water-soluble mold wash:

Forming material: 100 parts by weight of zircon powder (#325 and under)

Water-soluble binding agent: 40 parts by weight of 1% aqueous solution of carboxymethyl-cellulose Water-glass: 1 part by weight

COMPARATIVE EXAMPLE 2

Refractory particles: 100 parts by weight of Flattery silica sand

Powdered water-soluble binding agent: 1 part by weight of sodium silicate (No. 2)

The same mold wash was used.

COMPARATIVE EXAMPLE 3

Refractory particles: 100 parts by weight of Flattery silica sand

Powdered water-soluble binding agent: 2 parts by weight of sodium silicate (No. 2)

The same mold wash was used.

Figure 10:
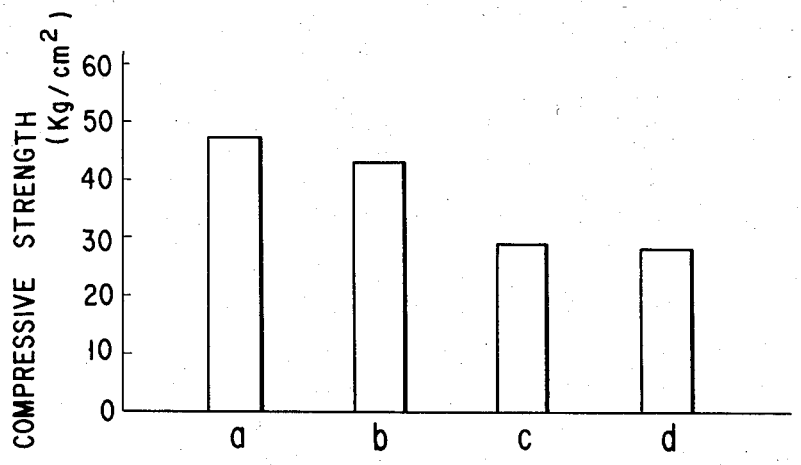
FIG. 10 is a graph showing the result of compressive strength tests conducted for test pieces made by curing the mold sand produced by mold sand producing systems shown in FIGS. 8 and 9, respectively, and comparative test pieces made by curing the mold sand produced by the prior art mold sand producing system.

FIG. 10 shows the results of measurements of compressive strength measured to the above-described test molds wherein reference characters a and b denote ones made in Example 3, a using mold sand obtained by the vacuum drying process and b using mold sand obtained by the hot coating process, reference character c indicates the test mold made in Comparative Example 2 and d made in Comparative Example 3.

As can be seen from FIG. 10, in the conventional powder mixing type process (Comparative Example), no appreciable difference is found in the compressive strength even if the amount of addition of powdered binding agent is changed, whilst a high strength in terms of compressive strength which is as high as 42.0 to 47.2 $Kg/cm^2$ is obtained in the test molds according to the vacuum drying process and the hot coating process. Further, the surface of mold sand cannot be cured without application of water-soluble mold wash.

While the described embodiment represents the preferred form of the present invention, it is to be understood that modifications will occur to those skilled in the art without departing from the spirit of the invention. The scope of the invention is therefore to be determined solely by the appended claims.

What is claimed is:

1. A process for making a foundry mold for use in metal casting, which comprises the steps of:

(a) heating and drying mold sand composed of refractory particles and a water-soluble binding agent;

(b) charging a cavity formed in a mold pattern with the dried mold sand while keeping, moisture on the inside surface of the cavity which corresponds to the peripheral surface of a mold to be made, and (c) heating the mole pattern of which the cavity has been filled completely with the mold sand to thereby cure the peripheral surface of the mold.

2. The process for making a mold as claimed in claim 1, characterized in that said mold sand is a mixture of refractory particles and a water-soluble binding agent.

3. The process for making a mold as claimed in claim 1, characterized in that said mold sand is composed of refractory particles, each of said particles having its surface being coated with a water-soluble binding agent.

4. The process for making a mold as claimed in claim 1, characterized in that mold pattern is heated by exposing it to microwave energy.

5. The process for making a mold as claimed in claim 1, said mold said is produced by a vaccum drying process in which refractory particles and a water-soluble binding agent are charged into and stirred by a reversed current type high speed mixer having a vacuum rotary dram and agitator means which are rotated in opposite direction.

6. The process for making a mold as claimed in claim 1, said mold sand is produced by a hot coating process in which previously heated refractory particles are stirred by a high speed mixer or reversed current type high speed mixer while adding aqueous solution of the watersoluble binding agent.

7. The process for making a mold as claimed in claim 1, characterized in that before the pattern is filled with the mold sand the inside surface of said cavity is coated with a water-soluble mold wash to form a coating layer thereby keeping moisture on the inside surface of the cavity.

8. The process for making a mold as claimed in claim 7, characterized in that said water-soluble mold wash is applied to the inner surface of the cavity by pouring it into the cavity and then turning over the pattern upside down.

9. The process for making a mold as claimed in claim 7, characterized in that the inner surface of said cavity is coated with a water-soluble mold wash by spraying it over the surface of the cavity.

10. The process for making a mold as claimed in claim 1, characterized in that before the pattern is filled with the mold sand the inside surface of said cavity is coated with water to form a water film layer thereby keeping moisture on the inside surface of the cavity.

11. The process for making a mold as claimed in claim 10, characterized in that water is applied to the inner surface of the cavity by pouring it into the cavity and then turning over the pattern upside down.

12. The process for making a mold as claimed in claim 10, characterized in that the inner surface of said cavity is coated with water by spraying it over the surface of said cavity.

* * * * *